US008256234B2

(12) United States Patent
Watson et al.

(10) Patent No.: US 8,256,234 B2
(45) Date of Patent: Sep. 4, 2012

(54) METHOD AND APPARATUS FOR COOLANT CONTROL WITHIN REFRIGERATORS

(75) Inventors: Eric K. Watson, Crestwood, KY (US); Omar Haidar, Louisville, KY (US); Matthew William Davis, Prospect, KY (US); Ronald Scott Tarr, Louisville, KY (US)

(73) Assignee: General Electric Company, Schenectady, NY (US)

( * ) Notice: Subject to any disclaimer, the term of this patent is extended or adjusted under 35 U.S.C. 154(b) by 935 days.

(21) Appl. No.: 12/333,738

(22) Filed: Dec. 12, 2008

(65) Prior Publication Data

US 2010/0147005 A1 Jun. 17, 2010

(51) Int. Cl.
*F25C 5/08* (2006.01)

(52) U.S. Cl. ..... 62/73; 62/351

(58) Field of Classification Search ..... 62/73, 351, 62/352

See application file for complete search history.

(56) References Cited

U.S. PATENT DOCUMENTS 1,511,219 A * 10/1924 Horton ..... 62/73
1,896,953 A * 2/1933 Hassell ..... 62/185
1,936,575 A * 11/1933 Barrett et al. ..... 62/67
2,866,322 A * 12/1958 Muffly ..... 62/137
5,367,885 A * 11/1994 Sagar ..... 62/125
7,337,617 B2 * 3/2008 Anderson ..... 62/66
2006/0086135 A1 * 4/2006 Wu et al. ..... 62/351
2006/0207282 A1 * 9/2006 Visin et al. ..... 62/351
2011/0219789 A1 * 9/2011 Grosse et al. ..... 62/73

OTHER PUBLICATIONS

Leigh Pratt Institute, Brooklyn, NY 11205 Jul. 1992 Economic Assessment of the Thin Polymer Icemaker BNL 48013; DE93005532 Abstract.*

* cited by examiner

*Primary Examiner* — Frantz Jules
*Assistant Examiner* — Alexis Cox
(74) *Attorney, Agent, or Firm* — Global Patent Operation; Douglas D. Zhang

(57) ABSTRACT

A method for cooling an icemaker is disclosed. The icemaker includes an ice mold body having a channel for transport of coolant and a plurality of ice cavities. The method includes the steps of injecting a coolant into the channel, adding water to the ice cavities, forming ice cubes in the ice cavities, removing coolant from the channel, heating the ice mold body, and ejecting the ice cubes from the ice mold body. The removal step is performed by reversing direction of a coolant pump.

6 Claims, 6 Drawing Sheets

METHOD AND APPARATUS FOR COOLANT CONTROL WITHIN REFRIGERATORS

BACKGROUND OF THE INVENTION

The present invention relates generally to refrigerators with icemakers housed within the fresh food compartment, and more specifically, to methods and apparatus for cooling icemakers in such refrigerators.

Generally, a refrigerator includes an evaporator, a compressor, a condenser, and an expansion device.

The evaporator receives coolant from the refrigerator in a closed loop configuration where the coolant is expanded to a low pressure and temperature state to cool the space and objects within the refrigerator.

It is also now common in the art of refrigerators, to provide an automatic icemaker. In a "side-by-side" type refrigerator where the freezer compartment is arranged to the side of the fresh food compartment, the icemaker is usually disposed in the freezer compartment and delivers ice through an opening in the access door of the freezer compartment. In this arrangement, ice is formed by freezing water with cold air in the freezer compartment, the air being made cold by the cooling system or circuit of the refrigerator. In a "bottom freezer" type refrigerator where the freezer compartment is arranged below a top fresh food compartment, convenience necessitates that the icemaker be disposed in the access door of the top mounted fresh food compartment and deliver ice through an opening in the access door of the fresh food compartment, rather than through the access door of the freezer compartment. It is known in the art, that a way to form ice in this configuration is to deliver cold air, which is cooled by the evaporator of the cooling system, through an interior cavity of the access door of the fresh food compartment to the icemaker to maintain the icemaker at a temperature below the freezing point of water.

When a liquid coolant is used to cool the ice mold body, the heating of the ice mold body heats the liquid coolant within the ice mold body. This requires more energy to be expended than would be required to heat the ice mold body itself because not only does the material of the ice mold body need to be heated to a temperature above the freezing point of water, the mass of coolant contained within the ice mold body must also be heated. This heated coolant must subsequently be cooled again so that more ice can be formed. This process increases ice production time because of the extra time required to heat the coolant within the ice mold body, and the extra time required to cool the heated coolant for production of new ice.

Therefore, an ability to operate more efficiently, both in speed of ice preparation and maintenance of the refrigerator is desired. Therefore, it would be desirable to provide a method and apparatus for making maintenance and ice production more efficient.

BRIEF DESCRIPTION OF THE INVENTION

As described herein, the exemplary embodiments of the present invention overcome one or more of the above or other disadvantages known in the art.

One aspect of the present invention relates to a method of cooling an icemaker. The icemaker comprises an ice mold body having a channel for transport of coolant and a plurality of ice cavities. The method comprises the steps of: injecting a coolant into the channel, adding water to the ice cavities, forming ice cubes in the ice cavities, removing coolant from the channel, heating the ice mold body, and ejecting the ice cubes from the ice mold body.

Another aspect relates to a refrigerator. The refrigerator comprises a food storage compartment, an access door operable to selectively close the food storage compartment, an icemaker compartment mounted on the access door, an icemaker disposed in the icemaker compartment and comprising an ice mold body, the ice mold body defining therein a plurality of ice cavities for containing water therein for freezing into ice cubes, and a channel for transport of a coolant within the ice mold body, at least one heating element attached to the ice mold body, a reversible coolant pump, a conduit for transport of a coolant between the ice mold body and the reversible coolant pump, and a controller for regulating the reversible coolant pump direction.

Another aspect of the present invention relates to a method of removing a door from a main body of a refrigerator. The door includes an icemaker compartment, and an ice mold body is disposed in the icemaker compartment and has a plurality of ice cavities for containing water therein for freezing into ice cubes. A conduit extends from the main body into the icemaker compartment for delivering an ice forming medium to the icemaker compartment. The refrigerator has a reversible pump for moving the ice forming medium from a tank to the icemaker compartment along the conduit. The method includes reversing a direction of the reversible pump to move the ice forming medium from the icemaker compartment back to the tank; and separating the door from the main body after the door is substantially free of the ice forming medium.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE EXEMPLARY EMBODIMENTS OF THE INVENTION

Figure 1:
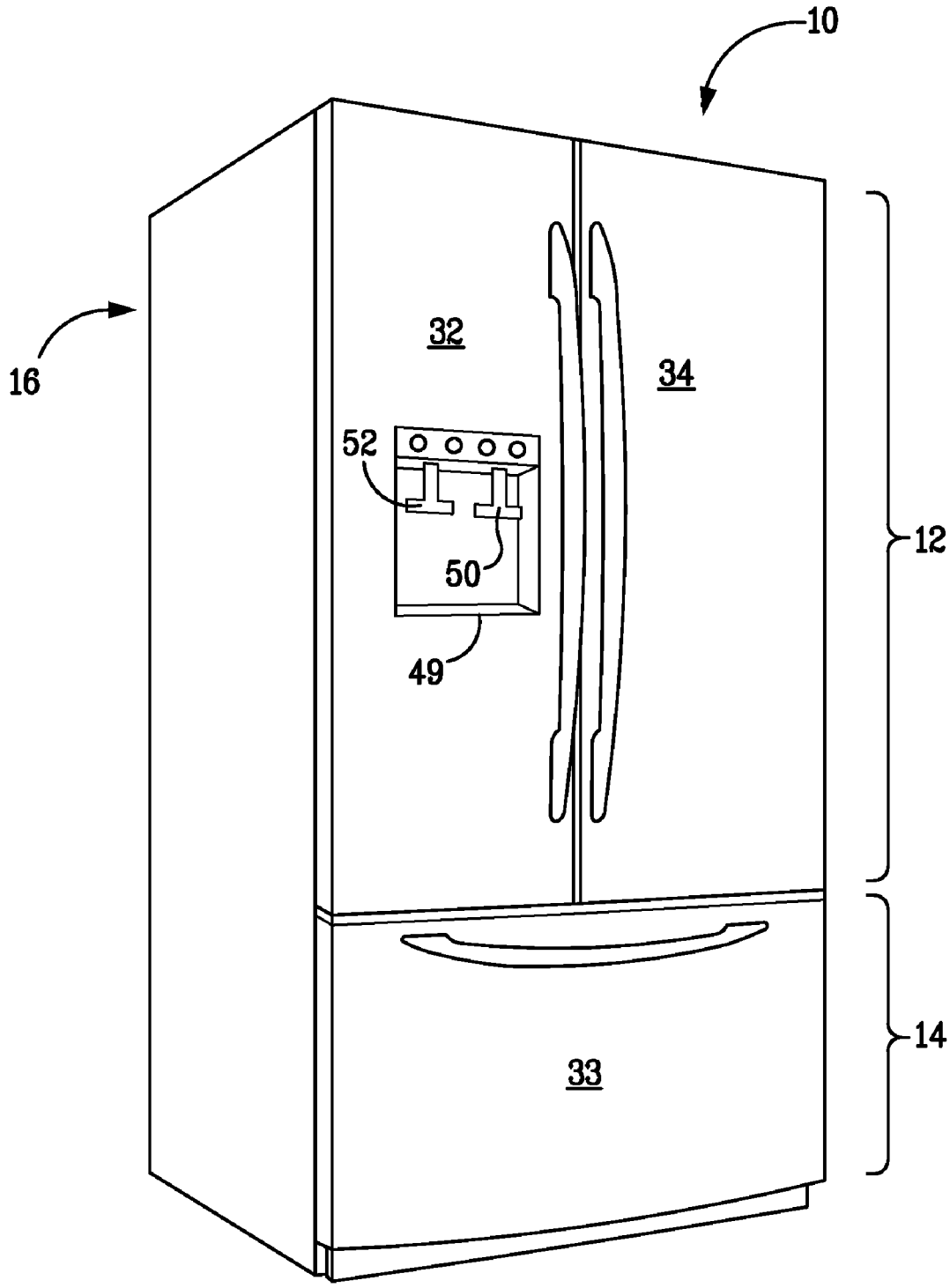
FIG. 1 is a perspective view of a refrigerator in accordance with an exemplary embodiment of the present invention.

FIG. 1 illustrates an exemplary refrigerator 10. While the embodiments are described herein in the context of a specific refrigerator 10, it is contemplated that the embodiments may be practiced in other types of refrigerators. Therefore, as the benefits of the herein described embodiments accrue generally to an icemaking apparatus and coolant pump control within the refrigerator, the description herein is for exemplary purposes only and is not intended to limit practice of the invention to a particular refrigeration appliance or machine, such as refrigerator 10.

On the exterior of the refrigerator 10, there is an external recessed access area 49 for dispensing of drinking water and ice cubes. Upon a stimulus, a water dispenser 50 allows an outflow of drinking water into a user's receptacle (not shown). Upon another stimulus, an ice dispenser 52 allows an outflow of ice cubes into a user's receptacle. There are two access doors, 32 and 34, to the fresh food compartment 12, and one access door 33 to the freezer compartment 14. Refrigerator 10 is contained within an outer case 16.

Figure 2:
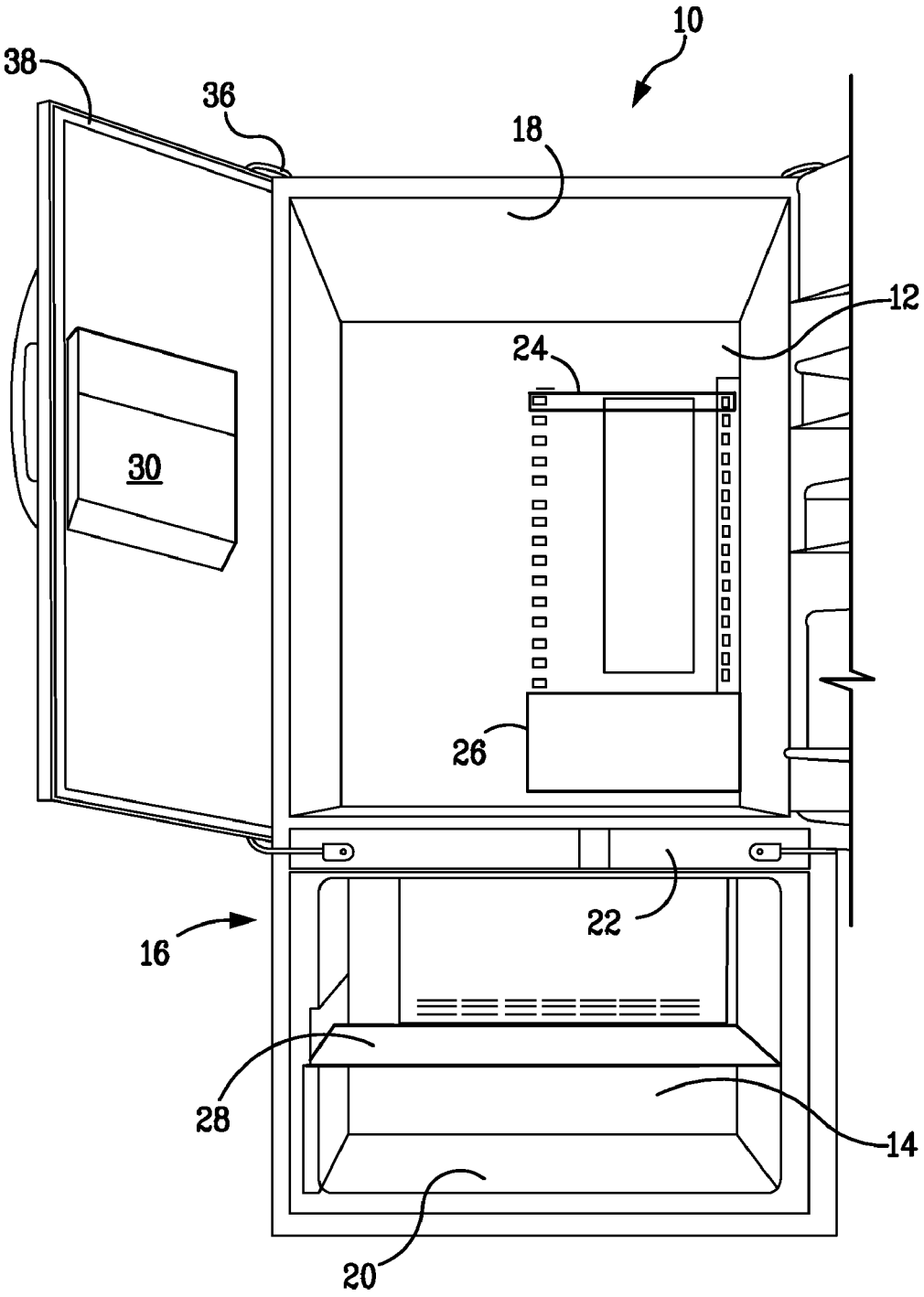
FIG. 2 is a perspective view of the refrigerator of FIG. 1 with the refrigerator doors being in an open position and the freezer door being removed for clarity.

FIG. 2 illustrates the refrigerator 10 with its upper access doors in the open position. Refrigerator 10 includes food storage compartments such as a fresh food compartment 12 and a freezer compartment 14. As shown, fresh food compartment 12 is disposed above freezer compartment 14 in a bottom mount refrigerator-freezer configuration. Refrigerator 10 includes an outer case 16 and inner liners 18 and 20 for compartments 12 and 14, respectively. A space between outer case 16 and liners 18 and 20, and between liners 18 and 20, is filled with foamed-in-place insulation. Outer case 16 normally is formed by folding a sheet of a suitable material, such as pre-painted steel, into an inverted U-shape to form top and side walls of the case. A bottom wall of outer case 16 normally is formed separately and attached to the case side walls and to a bottom frame that provides support for refrigerator 10. Inner liners 18 and 20 are molded from a suitable plastic material to form fresh food compartment 12 and freezer compartment 14, respectively. Alternatively, liners 18, 20 may be formed by bending and welding a sheet of a suitable metal, such as steel. The illustrative embodiment includes two separate liners 18, 20 as it is a relatively large capacity unit and separate liners add strength and are easier to maintain within manufacturing tolerances.

The insulation in the space between the bottom wall of liner 18 and the top wall of liner 20 is covered by another strip of suitable resilient material, which also commonly is referred to as a mullion 22. Mullion 22 in one embodiment is formed of an extruded ABS material.

Shelf 24 and slide-out drawer 26 can be provided in fresh food compartment 12 to support items being stored therein. A combination of shelves, such as shelf 28 is provided in freezer compartment 14.

Left side fresh food compartment door 32, right side fresh food compartment door 34, and a freezer door 33 close access openings to fresh food compartment 12 and freezer compartment 14, respectively. In one embodiment, each of the doors 32, 34 are mounted by a top hinge assembly 36 and a bottom hinge assembly (not shown) to rotate about its outer vertical edge between a closed position, as shown in FIG. 1, and an open position, as shown in FIG. 2. Icemaker compartment 30 can be seen on the interior of left side fresh food compartment door 32.

Figure 3:
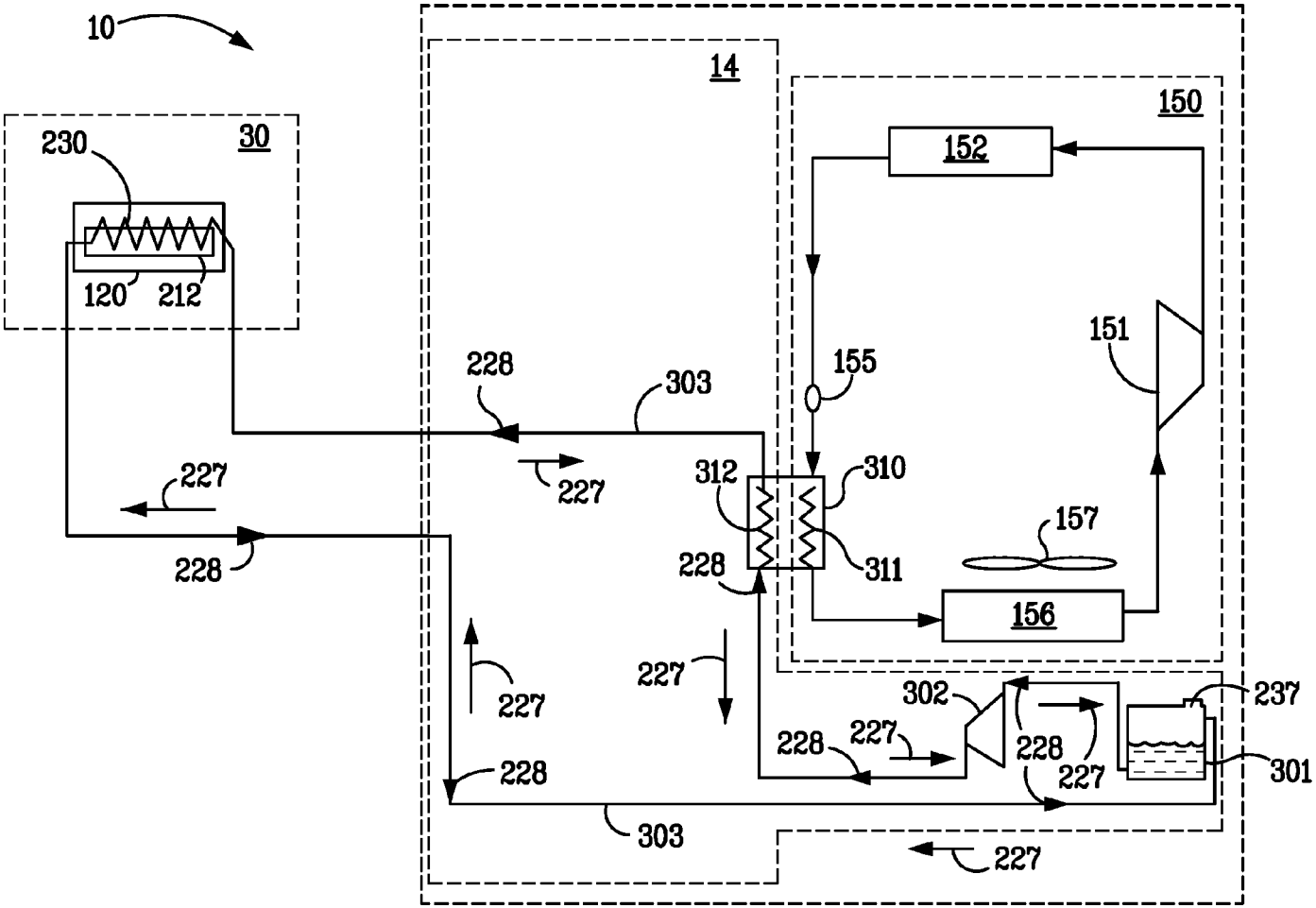
FIG. 3 is a schematic view of the refrigerator of FIG. 1, showing one exemplary embodiment of the cooling circuit.

FIG. 3 is a schematic view of refrigerator 10. In accordance with the first exemplary embodiment of the present invention, refrigerator 10 includes an area that at least partially contains components for executing a known vapor compression cycle for cooling air in the compartments. The components include a compressor 151, a condenser 152, an expansion device 155, and an evaporator 156, connected in series and charged with a working medium. Collectively, the vapor compression cycle components 151, 152, 155 and 156 are referred to herein as sealed system 150. The sealed system 150 utilizes a working medium, such as R-134a. The working medium flows in tubes or conduits connecting the components of the sealed system 150. The construction of the sealed system 150 is well known and therefore not described in detail herein.

The sealed system 150 has a compressor 151 for compressing a working medium. When compressed, the working medium becomes heated. The working medium is decompressed or vaporized at expansion device 155 thereby decreasing the temperature of the working medium. The working medium passes through heat exchanger 310 before entering evaporator 156. Evaporator 156 may have a fan 157 to circulate air from freezer compartment 14 (as seen in FIG. 2) in a plenum (not shown) past evaporator 156 and back to freezer compartment 14 thereby cooling freezer compartment 14.

Referring back to FIG. 3, heat exchanger 310 thermally connects the sealed system 150 with the icemaker compartment 30. Heat exchanger 310 utilizes heat transfer to the freezer compartment 14 (as seen in FIG. 2) as a means of cooling the coolant for icemaker compartment 30.

The icemaker compartment 30 includes an ice mold body 120, having a channel 212 for the transport of coolant within ice mold body 120. Components of the system to distribute coolant include a coil 312, channel 212, a second heat exchanger 230, a tank 301, a reversible coolant pump 302, and a coolant conduit 303 for transport of the coolant between channel 212 and the reversible coolant pump 302. Coil 312, reversible coolant pump 302, and tank 301 may be disposed in freezer compartment 14.

Heat exchanger 310 has coil 311 as a part of the sealed system 150 and coil 312 as a part of the system to distribute coolant to icemaker compartment 30. Coil 311 and coil 312 are operatively coupled in a heat exchange relationship either through direct contact or indirectly through a thermally conductive medium such as a working fluid. In the exemplary embodiment of FIG. 3, the coils 311 and 312 are in thermal communication through a working fluid contained in heat exchanger 310, thereby transferring heat from one system to the other. It can be appreciated that coil 312 may be removed and the coolant may flow around coil 311 thereby transferring heat directly to the coolant without the use of a working fluid. Other arrangements for thermally linking coils 311 and 312 could be similarly employed. Reversible coolant pump 302 moves the coolant from tank 301 through heat exchanger 310 to icemaker compartment 30.

Second heat exchanger 230 thermally connects the coolant with the icemaker compartment 30. Channel 212 also thermally connects the coolant to the interior of the icemaker compartment 30, and specifically the interior of ice mold body 120.

When the coolant is a liquid, such as a food safe liquid in the nature of a mixture of propylene glycol and water, distribution of coolant to the icemaker compartment 30 can be achieved as follows. Transport of the coolant within refrigerator 10 includes the coolant passing through heat exchanger 310, second heat exchanger 230, and reversible coolant pump 302, which delivers the pressure to circulate the coolant within icemaker compartment 30. Second heat exchanger 230 thermally couples the circulating coolant in a heat exchange relationship with the ice mold directly or indirectly. In the exemplary embodiment of FIG. 3, channel 212, which carries the coolant is formed by the ice mold body 120. By this arrangement, the portion of ice mold body 120 that defines the channel 212 is in direct thermal contact with the coolant to provide the heat exchange relationship between the coolant and the mold body.

When operating in the cooling mode, the reversible coolant pump 302 is circulating coolant in a substantially counterclockwise direction, shown by arrows 228 in FIG. 3. The tank 301 has an output port positioned below the coolant level in the tank 301 and an input port positioned above the coolant level in the tank 301. As the coolant passes through coil 312 of heat exchanger 310, heat is transferred from the coolant to the refrigerant passing through coil 311. The, cooled coolant then passes through the second heat exchanger 230, removing heat from the ice mold body 120 to keep the temperature of the ice mold body 120 below the freezing point of water. The cooling of the ice mold body 120 in this fashion also serves to cool the interior of the icemaker compartment 30.

Reversible coolant pump 302 can also operate in a reverse direction, as shown by arrows 227. When reversible coolant pump 302 operates in a reverse direction, creating a negative pressure, the coolant that is in channel 212 gets removed, leaving channel 212 substantially empty. It is helpful to remove the coolant from the channel 212 during ice harvest when the ice mold body is typically heated to a temperature above the freezing point of water so that the ice cubes melt slightly and can be ejected from the ice mold body more easily; otherwise, additional energy will be used to heat the coolant. This volume of coolant from channel 212 travels along the path indicated by arrows 227 and extra volume is stored within tank 301. Port 237 in tank 301 can be used by a service professional to add additional volume of coolant to the system, or remove extra coolant volume.

Figure 3A:
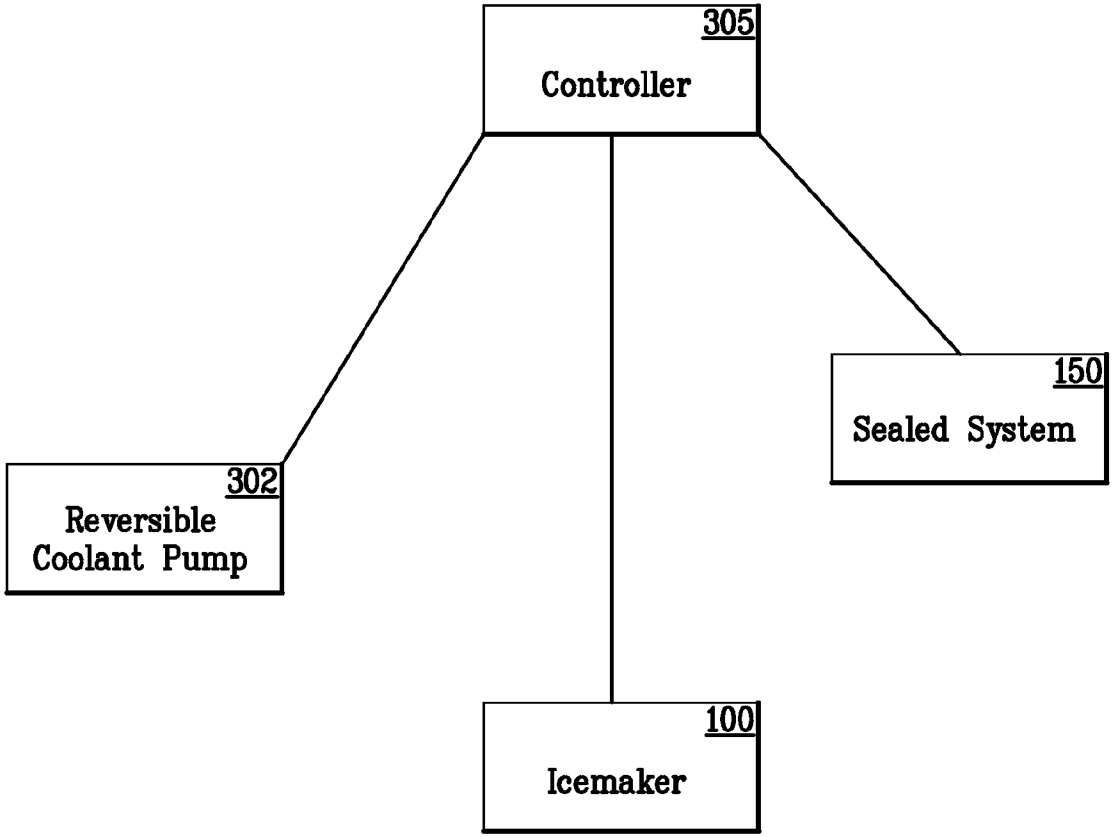
FIG. 3A is a block diagram of the exemplary controller.

FIG. 3A is a block diagram of exemplary controller 305. Controller 305 is in communication with icemaker 100, sealed system 150, an icemaker fan (not shown) and reversible coolant pump 302. Controller 305 is in communication with reversible coolant pump 302, giving direction to pump forward, injecting coolant into channel 212 or reverse pumping thereby substantially removing all coolant from channel 212.

Figure 4:
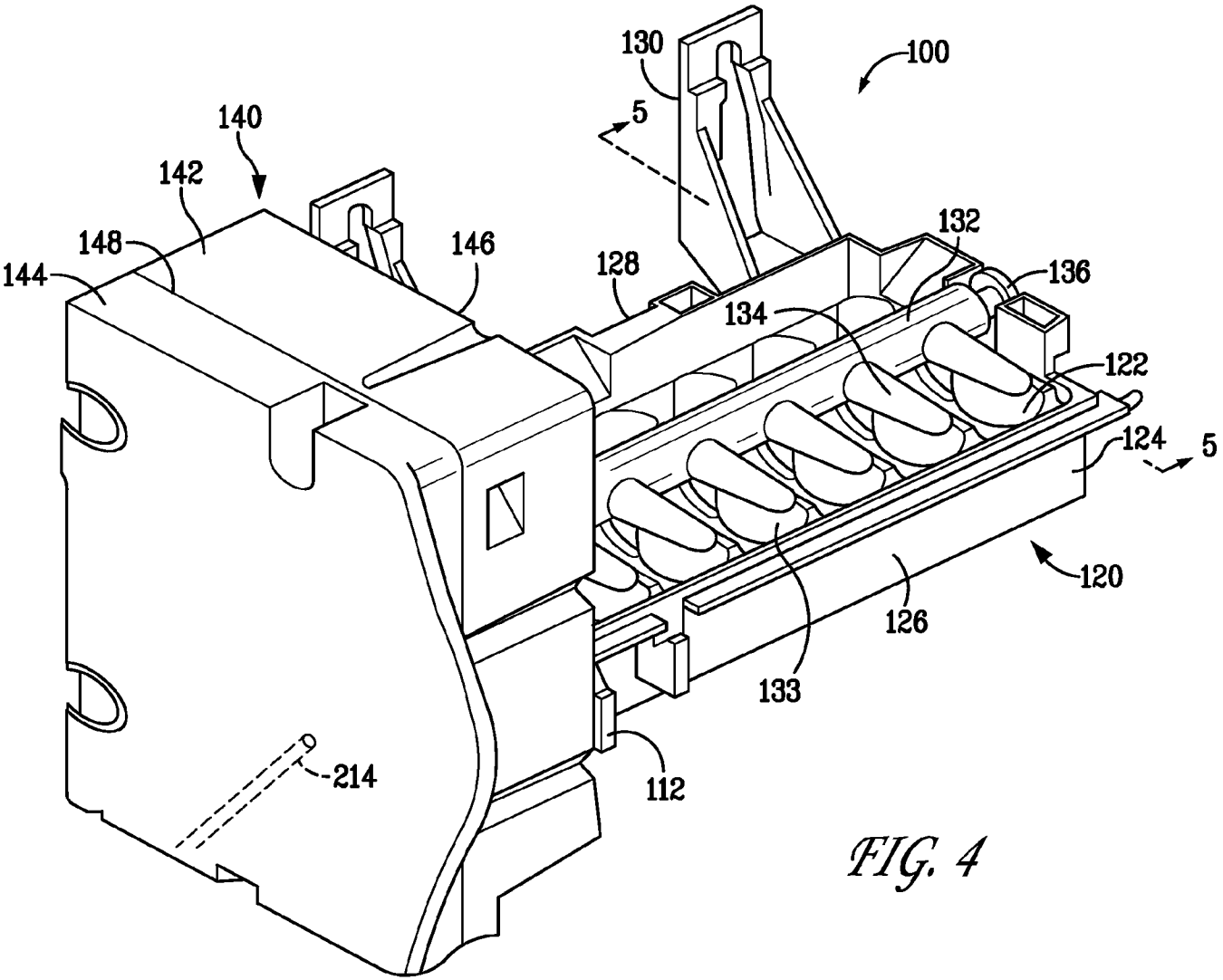
FIG. 4 is a perspective view of the icemaker of FIG. 1.

FIG. 4 is a perspective view of icemaker 100 illustrating ice mold body 120 and a control housing 140. Ice mold body 120 includes an open top 122 extending between a mounting end 112 and a free end 124 of ice mold body 120. Ice mold body 120 also includes a front face 126 and a rear face 128. Front face 126 is substantially aligned with ice storage bin 240 (shown in FIG. 5) when icemaker 100 is mounted within icemaker compartment 30 such that ice cubes or pieces 242 are dispensed from ice mold body 120 at front face 126 into ice storage bin 240. Referring back to FIG. 4, in one embodiment, brackets 130 extend upward from rear face 128.

Ice mold body 120 includes rake 132 which extends from control housing 140 along open top 122. Rake 132 includes individual fingers 134 received within each of the ice cavities 133 of ice mold body 120. In operation, rake 132 is rotated about an axis of rotation or rake axis 136 that extends generally parallel to front face 126 and rear face 128. A motor (not shown) is housed within control housing 140 and is used for turning or rotating rake 132 about axis of rotation 136.

In the exemplary embodiment, control housing 140 is provided at mounting end 112 of ice mold body 120. Control housing 140 includes a housing body 142 and an end cover 144 attached to housing body 142. Housing body 142 extends between a first end 146 and a second end 148. First end 146 is secured to mounting end 112 of ice mold body 120. Alternatively, housing body 142 and ice mold body 120 are integrally formed. The end cover 144 is coupled to second end 148 of housing body 142 and closes access to housing body 142. In an alternative embodiment, end cover 144 is integrally formed with housing body 142. Housing body 142 houses a motor and/or the controller (as seen in FIG. 3A).

Figure 5:
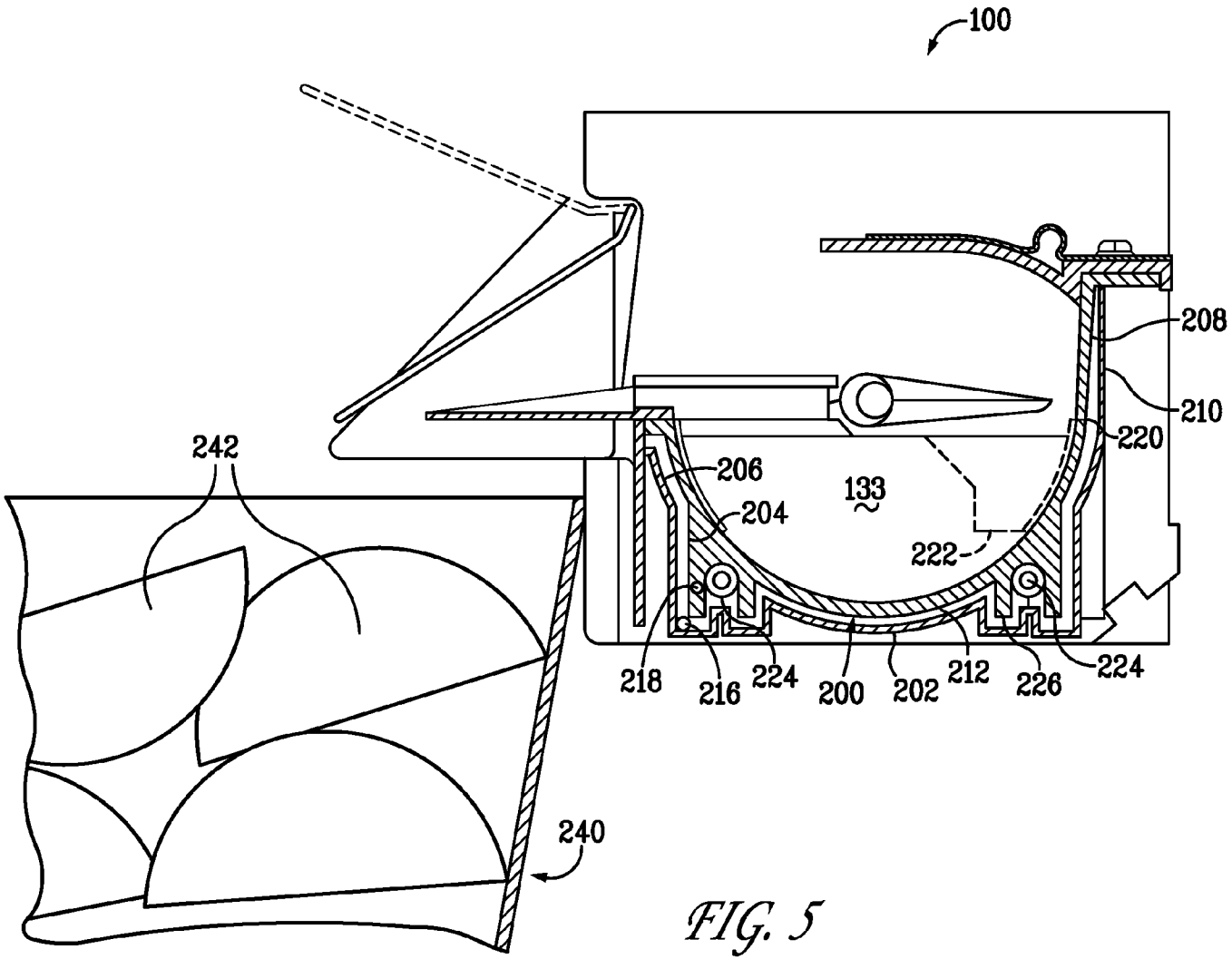
FIG. 5 is a cross sectional view of the icemaker of FIG. 4 along lines 5-5 together with an ice storage bin.

FIG. 5 is a cross sectional view of icemaker 100 taken along lines 5-5 of FIG. 4. Ice mold body 120 includes a bottom inner wall 200, a bottom outer wall 202, a front inner wall 204, a front outer wall 206, a rear inner wall 208 and a rear outer wall 210. The inner and outer walls of the ice mold body 120 form channel 212 through which coolant can pass. Coolant flows into channel 212 by passing through inlet 214 (as seen in FIG. 4). A coolant outlet 216 allows coolant to flow out of channel 212. Preferably, a temperature sensor such as a thermistor 218 is adjacent to and in thermal connection with ice mold body 120 and in this embodiment is shown to be connected to the inner front wall 204. The temperature sensor 218 is in communication with controller 305 for determination of temperature values during the ice making process.

A plurality of partition walls 220 extend transversely across ice mold body 120 to define the plurality of ice cavities 133 in which ice cubes 242 can be formed. Each partition wall 220 includes a recessed upper edge portion 222 by which water flows successively through and substantially fills the plurality of ice cavities 133 of ice mold body 120.

In this embodiment, two sheathed electrical resistance heating elements 224 are attached, such as by press-fitting, staking, and/or clamping into bottom support structure 226 of ice mold body 120. The heating elements 224 heat ice mold body 120 when a harvest cycle begins in order to slightly melt ice cubes 242 to allow the ice cubes to be released from ice cavities 133. Rotating rake 132 sweeps through ice mold body 120 as ice cubes are harvested and ejects the ice cubes from ice mold body 120 into ice storage bin 240. Cyclical operation of heating elements 224 and rake 132 are effected by controller 305, which also automatically provides for refilling ice mold body 120 with water for ice formation after ice is harvested.

The method of ice making in one aspect of the invention contains several steps. At the beginning of the cycle, the plurality of ice cavities 133 in ice mold body 120 are substantially empty of water and channel 212 within the ice mold body is substantially empty. A coolant is then injected into channel 212 through inlet 214. Water is added to the exterior of ice mold body 120, separated by a plurality of partition walls 220, substantially filling the plurality of ice cavities 133. The coolant within channel 212 cause the water in the ice mold body 120 to substantially freeze, and form ice cubes 242. After substantial freezing of the water in ice mold body 120, the coolant in channel 212 is removed through coolant outlet 216, leaving channel 212 substantially empty. Upon substantial emptying of channel 212, the heating elements 224 are activated, increasing the temperature of ice mold body 120. After a predetermined period of heating, rake 132 rotates along axis 136 causing the fingers 134 to eject the formed solid ice cubes 242. After ejection of ice cubes 242, the heating elements 224 are deactivated, allowing the ice mold body 120 to cool. After a pre-determined time, coolant is injected into channel 212 through inlet 214, and the cycle begins again. In other words, these steps are repeated one or more times.

Controller 305 is operatively connected to temperature sensor 218 which is in thermal communication with ice mold body 120. Controller 305 operates rake 132, and controls the addition of water for ice cubes, energization of the heating elements 224 and both injection and withdrawal of coolant from channel 212, based on values determined by temperature sensor 218. Controller also is also operatively connected to sealed system 150, and can call for operation of compressor 151, condenser 152, expansion device 155, and evaporator 156 if further cooling of freezer compartment 14 or second heat exchanger 230 is needed.

The fundamental novel features of the invention as applied to various specific embodiments thereof have been shown, described and pointed out, it will also be understood that various omissions, substitutions and changes in the form and details of the devices illustrated and in their operation, may be made by those skilled in the art without departing from the spirit of the invention. For example, the coolant pump 302 can be operated in a reverse direction to pump the coolant out of the channel 212 and the coolant conduit 303 before the door 32 is separated or removed from the main body of the refrigerator 10. Moreover, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method of cooling an icemaker, the icemaker comprising an ice mold body having a channel for transport of coolant and a plurality of ice cavities, the method comprising the steps of:

(a) injecting a coolant into the channel;

(b) adding water to the ice cavities;

(c) forming ice cubes in the ice cavities;

(d) removing the coolant from the channel;

(e) heating the ice mold body; and (f) ejecting the ice cubes from the ice mold body, wherein step a) is performed by delivering coolant under pressure from a coolant pump, and wherein step d) is performed by reversing the coolant pump.

2. The method of claim 1, further including repeating steps (a) through (f) one or more times.

3. The method of claim 1, wherein step (d) is performed by reversing the pressure.

4. A refrigerator comprising:

a food storage compartment;

an access door operable to selectively close the food storage compartment;

an icemaker compartment on the access door;

an icemaker disposed in the icemaker compartment and comprising an ice mold body, the ice mold body defining therein a plurality of ice cavities for containing water therein for freezing into ice cubes, and a channel for transport of a coolant within the ice mold body;

a reversible coolant pump;

a conduit for transport of a coolant between the ice mold body and the reversible coolant pump;

at least one heating element attached to the ice mold body, the heating element configured to heat the ice mold body when the channel of the ice mold body is substantially empty of coolant; and a controller for regulating the reversible coolant pump between a forward pumping state wherein the pump is configured to inject coolant under pressure into the channel of the ice mold body and a reverse pumping state wherein the pump is configured to remove coolant from the channel of the ice mold body at least until the channel is substantially empty of coolant.

5. The apparatus of claim 4, wherein the controller causes coolant to flow in a first direction prior to new ice formation in the ice mold body.

6. The apparatus of claim 5, wherein the controller causes coolant to flow in a second reverse direction prior to activation of the at least one heating element.

* * * * *